US010112200B2

(12) United States Patent
Grozdanich

(10) Patent No.: US 10,112,200 B2
(45) Date of Patent: Oct. 30, 2018

(54) COMPOSITE MILLING COMPONENT

(71) Applicant: Spokane Industries, Spokane, WA (US)

(72) Inventor: Rod Alan Grozdanich, Liberty Lake, WA (US)

(73) Assignee: Spokane Industries, Spokane, WA (US)

( * ) Notice: Subject to any disclaimer, the term of this patent is extended or adjusted under 35 U.S.C. 154(b) by 819 days.

(21) Appl. No.: 14/699,897

(22) Filed: Apr. 29, 2015

(65) Prior Publication Data

US 2016/0318026 A1 Nov. 3, 2016

(51) Int. Cl.
*B02C 17/16* (2006.01)
*B02C 17/10* (2006.01)
*B02C 17/22* (2006.01)

(52) U.S. Cl.
CPC ..... *B02C 17/163* (2013.01); *B02C 17/10* (2013.01); *B02C 17/22* (2013.01)

(58) Field of Classification Search
CPC ..... B02C 17/163; B02C 17/22; B02C 17/10
See application file for complete search history.

(56) References Cited

U.S. PATENT DOCUMENTS 3,226,044 A * 12/1965 Matsubayashi ..... B01F 7/242 241/172
3,841,805 A * 10/1974 Zalis ..... B29C 47/0844 415/196
3,948,003 A * 4/1976 Pletscher ..... B24B 31/00 451/328
4,013,233 A * 3/1977 Nylund ..... B02C 17/18 241/171
4,269,808 A * 5/1981 Kawabata ..... C22B 3/04 241/20
4,424,938 A * 1/1984 Day ..... B02C 17/225 241/182
4,435,082 A * 3/1984 Bishop ..... B01F 9/02 366/185
4,848,681 A * 7/1989 Eriksson ..... B02C 17/225 241/183
5,002,439 A * 3/1991 Lauder ..... B23C 5/10 407/119
5,062,601 A * 11/1991 Graf ..... B02C 17/184 241/171
5,114,083 A * 5/1992 Ikebuchi ..... B02C 17/16 241/153
5,419,056 A * 5/1995 Breitenstein ..... G01B 5/252 33/549
5,725,333 A * 3/1998 Abe ..... B23C 5/1081 407/118

(Continued)

*Primary Examiner* — Sean Michalski
(74) *Attorney, Agent, or Firm* — Lee & Hayes, PLLC

(57) ABSTRACT

A composite milling component comprising a composite region of ceramic material and metal is disclosed. The milling component may comprise a lifting member such as a digger shoe of a vertical tower mill, a flight liner of a vertical tower mill, a shell liner of a horizontal axis mill, and/or an end liner of a horizontal axis mill. The composite region may be formed into a portion of the milling component that experiences greater wear than other portions to increase a wear-resistance of the milling component. The composite region may be formed integrally into the milling component during a casting processes of the milling component.

20 Claims, 10 Drawing Sheets

(56) References Cited

U.S. PATENT DOCUMENTS 6,036,127 A * 3/2000 Moller ..... B02C 17/225 241/183
6,439,811 B1 * 8/2002 Wardell ..... B23C 5/10 407/54
7,887,000 B2 * 2/2011 Siitonen ..... B02C 17/1825 241/183
8,152,086 B2 * 4/2012 Moller ..... B02C 17/225 241/183
8,622,330 B2 * 1/2014 Mepham ..... B02C 17/225 241/182
9,884,379 B1 * 2/2018 Budda ..... B23C 5/207
2002/0076284 A1 * 6/2002 Kato ..... C23C 30/005 407/114
2005/0261795 A1 * 11/2005 Ghosh ..... A61C 13/0004 700/118
2006/0060053 A1 * 3/2006 Tanaka ..... B23C 5/10 83/663
2008/0219782 A1 * 9/2008 Flynn ..... B23C 5/10 407/42
2008/0308659 A1 * 12/2008 Grasso, Jr. ..... C04B 14/22 241/23
2009/0283018 A1 * 11/2009 Grasso, Jr. ..... B02C 17/22 106/709
2010/0129165 A1 * 5/2010 Hughes ..... B23C 5/1036 407/42
2010/0183383 A1 * 7/2010 Volokh ..... B23C 5/10 407/54
2010/0209201 A1 * 8/2010 Davis ..... B23C 5/10 407/60
2010/0215447 A1 * 8/2010 Davis ..... B23C 5/10 407/115
2011/0211922 A1 * 9/2011 Maeda ..... B23C 5/1009 407/54
2012/0183363 A1 * 7/2012 Davis ..... B23C 5/10 407/54
2013/0062449 A1 * 3/2013 Kumar ..... B02C 17/10 241/284
2013/0146688 A1 * 6/2013 Palumbo ..... B02C 17/00 241/22
2013/0327863 A1 * 12/2013 Palladini ..... B02C 17/225 241/183
2014/0001294 A1 * 1/2014 Allen ..... B02C 17/16 241/27
2015/0033529 A1 * 2/2015 Allen ..... B25J 9/042 29/402.01

* cited by examiner

COMPOSITE MILLING COMPONENT

BACKGROUND

Industrial mills are used to process mined ores and cement, breaking these materials apart into smaller constituents for further processing or transportation. Mills generally include a housing with a feeder inlet for receiving the raw materials. A grinding media, such as ceramic balls, may be enclosed within the housing. The grinding media generally has a hardness greater than the raw materials so that continuous collisions with the grinding media cause the raw material to break apart. In some instances, the raw materials may be ground in a mill without the addition of a grinding media, but by colliding with itself.

Some mills, such as vertical tower mills (e.g., that use a screw-shaft) and horizontal axis mills (e.g., autogenous grinding mills, semi-autogenous grinding (SAG) mills, rod mills, and ball mills) have a lifting member to elevate the raw material or combined mixture of grinding media and raw material. The combined mixture then falls from the lifting member back to a bottom area of the mill, providing collisions between the grinding media and the raw material, as well as with the bottom surface of the mill. The lifting member may continuously rotate through the combined mixture causing a continuous cascade and/or stirring of the material, effectively breaking it apart.

However, the raw material or combined mixture of grinding media and raw material can cause some portions of the internal components of the mill to experience greater wear than other portions. Even when a relatively small portion of a component wears down, the entire component must be replaced, which can increase the costs of maintaining the mill. Furthermore, milling activity must be halted to replace the worn component, negatively impacting productivity. Some milling components can weigh between 500 and 2,000 lbs, so installing/replacing them requires substantial man power and safety concerns.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
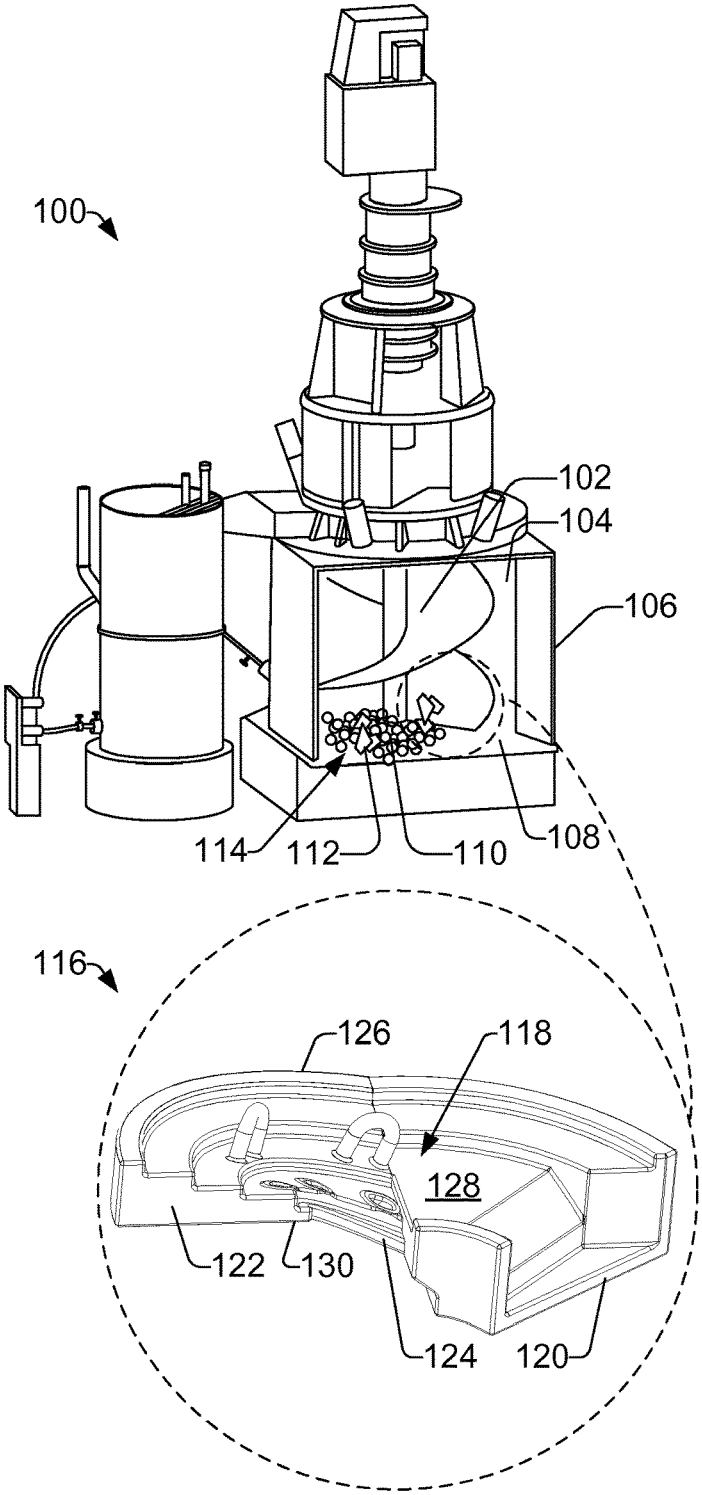
FIG. 1 illustrates a perspective view of an example vertical tower mill with a screw-shaft and an example lifting member, e.g., a digger shoe, that may be mounted onto the screw-shaft.

As discussed above, components of mills often wear down and must be replaced, stalling the milling operation and increasing the maintenance needs of the mill. However, milling components do not experience wear at every portion equally. Rather, certain portions of a milling component may wear down faster than others, sometimes from collisions with a grinding media and/or a raw material that is being milled. Yet the entire component must be replaced, even if only a relatively small portion has worn down. Therefore, increasing (for instance, doubling) a longevity of only a portion of the milling component can increase (for instance, double) a longevity of the entire milling component.

This disclosure is directed to milling components with a composite region which may comprise a composite of a cast metal and a ceramic material. The composite region may be formed at a portion of the milling component that experiences more wear during use than other portions of the milling component. The milling component with the composite region may have increased longevity due to enhanced wear-resistance at the composite region.

In some examples, the mill may comprise a vertical tower mill with a screw-shaft. The vertical tower mill may be used as a third or fourth stage of grinding, for instance, to grind a previously ground material into even smaller particles, such as small grains, pebbles, or powder. The milling component may comprise a digger shoe that may be mounted onto a bottom portion of the screw-shaft. The digger shoe may scoop up and/or stir a mixture of raw material to be ground and a grinding media as the screw-shaft rotates. In some instances, the digger shoe may include a shovel feature with at least an outer portion comprising a composite region. In some instances, the composite region may comprise a ceramic material embedded in a cast metal of the digger shoe. The composite region may increase a wear-resistance of the digger shoe, while also not adding a significant weight to the digger shoe. In fact, due to a lower density of some ceramic materials relative to some metals, embedding a ceramic material in a metal of the outer portion of the digger shoe may decrease a moment of inertia of the screw-shaft as it rotates, lowering the overall energy requirements of the mill.

In some embodiments, the mill may comprise a horizontal axis mill and the lifting member may comprise a liner of the horizontal axis mill. For instance, the mill may comprise an autogenous grinding mill (auto) mill, a semi-autogenous grinding (SAG) mill, a rod mill, or a ball mill. The lifting member may comprise a shell liner or an end liner mounted to an interior surface of a mill housing with one or more protruding lifting bars. As the housing rotates, the lifting member may pass through a raw material or a mixture of raw material and grinding media disposed at a bottom portion of the mill and some of the mixture may get caught between the one or more protruding lifting bars. As the lifting member continues to rotate with the housing, the raw material and/or mixture may fall from the lifting member back down to the bottom portion, providing the collisions that grind/break apart the raw material. In some examples, portions of the shell liner, end liner, and/or the lifting bar may comprise a composite region to increase wear-resistance of that portion which increases an overall longevity of the milling component.

In some examples, a method of manufacturing a composite milling component may be implemented. The method may comprise determining a portion of a milling component that experiences more wear than other portions of the milling component. The method may comprise forming a casting mold into a shape of the lifting member, forming a ceramic material into a shape of the determined portion, and/or placing or securing the ceramic material into the mold at a location (or multiple locations) that correspond to a location of the determined portion. The method may also comprise pouring a molten metal into the casting mold and cooling the molten metal. The method may also comprise other steps, as discussed in greater detail below.

Multiple and varied example implementations and embodiments are described throughout. However, these examples are merely illustrative and other implementations and embodiments of a composite milling component may be implemented without departing from the scope of the disclosure. For instance, the implementations, or portions thereof, may be rearranged, combined, used together, duplicated, partially omitted, omitted entirely, and/or may be otherwise modified to arrive at variations on the disclosed implementations.

Illustrative Composite Component for Tower Mill

FIG. 1 illustrates an example mill 100 (e.g., a tower mill) which may comprise a vertical screw shaft 102 within an interior space 104 of a housing 106. The vertical screw shaft 102 may extend to a bottom portion 108 of the housing 106 and may penetrate a layer of grinding media 110 (e.g., ceramic spheres, metal spheres, or other hard materials), which may be mixed with a raw material to be ground 112 (e.g., iron ore, copper ore, and/or cement) to form a grinding media/raw material mixture 114 disposed at the bottom portion 108 or on a bottom surface of the interior space 104 of the mill 100. In some examples, the interior space 104 may comprise the raw material 112 without the grinding media 110, in which case the raw material 112 may collide with itself during a grinding processes. In some examples, a lifting member, such as a digger shoe 116, may be mounted onto the vertical screw shaft 102 proximate to the bottom portion 108 and may scoop up some of the grinding media/raw material mixture 114 when the vertical screw shaft 102 rotates.

In some instances, the rotating of the vertical screw shaft 102 may cause the digger shoe 116 to continually scoop the grinding media/raw material mixture 114 up onto a body 118 of the digger shoe 116. As the vertical screw shaft 102 continues to rotate, the digger shoe 116 may collect more of the grinding media/raw material mixture 114, pushing it further up the vertical screw shaft 102, past the mounted digger shoe 116, and onto other liners (e.g., flight liners) mounted on the vertical screw shaft 102 above the digger shoe 116. The grinding media/raw material mixture 114 may move up the vertical screw shaft 102, pushed by more grinding media/raw material mixture behind it, until it slides off a side of the vertical screw shaft 102 and falls from its elevated position on the vertical screw shaft 102 back to the bottom portion 108 of the mill 100.

In some examples, the rotating vertical screw shaft 102, which provides a continuous flow of the grinding media/raw material mixture 114 up the vertical screw shaft 102 and back down to the bottom portion 108 of the mill 100, may cause the grinding media 110 to have multiple collisions with the raw material 112. The collisions may cause the raw material 112 to break apart, effectively grinding it into smaller constituents (e.g., pebbles, powder, smaller rocks). However, kinetic energy added to the grinding media/raw material mixture 114 by the rotations may cause collisions and/or sliding between the grinding media/raw material mixture 114 and the digger shoe 116, as well. Furthermore, there may be collisions and/or sliding between the grinding media/raw material mixture 114 and one or more flight liner/s mounted to the vertical screw shaft 102 above the digger shoe 116. Additionally or alternatively, the digger shoe 116 may experience wear from sliding against a surface of the bottom portion 108 (e.g., floor) or an inner side of the mill 100.

In some embodiments, the body 118 of the digger shoe 116 may comprise a first end 120 spaced apart from a second end 122 by a curved inner sidewall 124 and a curved outer sidewall 126. A terminating edge or multiple terminating edges of the first end 120 may define a first terminating plane of the digger shoe 116. Similarly a terminating edge or multiple terminating edges of the second end may define a second terminating plane. The digger shoe 116 may comprise a top surface 128 and a bottom surface 130, which are discussed in greater detail below with regard to FIGS. 2-4C.

In some examples, the digger shoe 116 may be configured to mount onto the vertical screw shaft 102, and may have a substantially helical shape about an axis. For instance, the substantially helical shape may comprise an annular/ring sector (e.g., a portion of a ring from the first terminating plane to the second terminating plane) that is extended along a vertical axis, e.g., spiraled around an axis passing through an origin of the annular/ring perpendicular to a radius of the annular/ring. For instance, the sector of the annular/ring may be formed on an x-y plane with an origin at the x-y plane origin and the first terminating plane forming an angle with the second terminating plane of between about 90° and about 180°. In this instance, the vertical axis would comprise the z-axis intersecting perpendicular to the x-y plane, and the sector would spiral about the z-axis.

Figure 2:
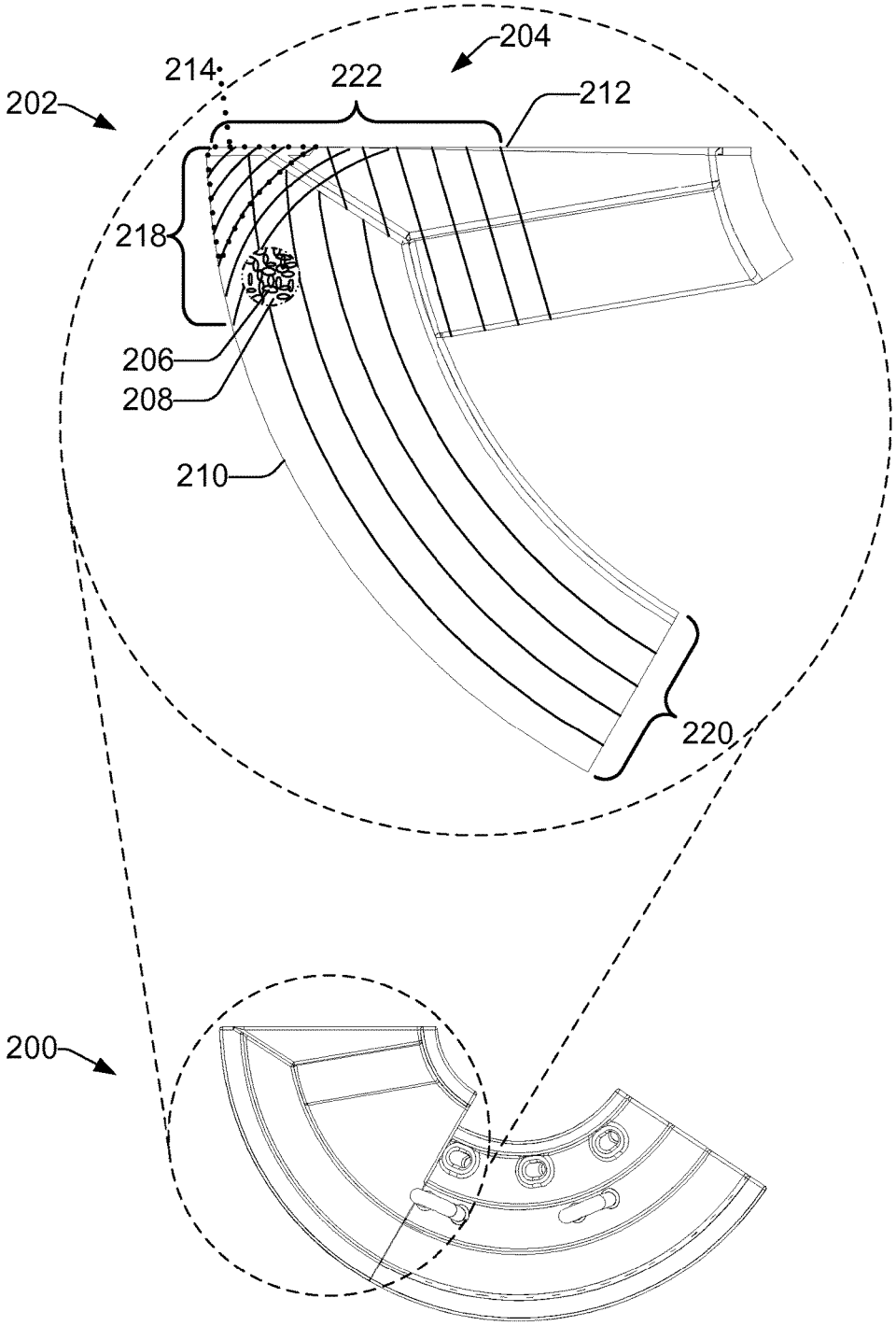
FIG. 2 illustrates a top view of an example digger shoe with a composite region and multiple embodiments of the composite region.

FIG. 2 shows a top view of an example digger shoe 200 and a top view of a portion 202 of the digger shoe 200 comprising a composite region 204. In some examples, the composite region 204 may comprise a ceramic material 206 surrounded (e.g., permeated, penetrated, enveloped, engulfed) by a metal 208. For instance, the ceramic material 206 may comprise a plurality of ceramic grains or particles (e.g., $Al_2O_3$, ZnO, $TiO_2$, FeO, $Fe_2O_3$, $SiO_2$, $ZrO_2$, $CrO_3$, $Cr_2O_3$, $B_2O_3$, $MoO_3$ $V_2O_5$, CuO, MgO, NiO, WC, TiC, SiC, $B_4C$, BN, $Si_3N_4$, fly ash, etc., and/or combinations thereof) embedded in the metal 208 (e.g., steel alloys, cast iron, white iron, high chrome iron, FeMnAl alloys, manganese steel, pig iron, nickel alloys, titanium alloys, carbon alloys, nitride alloys, boron alloys, and/or aluminum alloys). The ceramic material 206 may comprise a spherical shape, a rectangular prism-shaped, other crystalline shapes, irregular shapes (e.g., broken apart shards from a larger ceramic structure), or combinations thereof. Particles of the ceramic material 206 may have a greatest dimension of 0.1 mm to 1 mm, 1 mm-5 mm, or 5-10 mm. In some instances, all particles of the ceramic material 206 may be substantially uniform in shape and/or size, while in other instances the particles may substantially differ in shape and/or size. In some instances, a type, size, uniformity (or lack of uniformity), and/or shape of the ceramic material 206 may correspond to a characteristic, such as wear-resistance, provided to the digger shoe 200, or other lifting members, by the ceramic material 206.

In some examples, the composite region 204 including the ceramic material 206 may be integrally formed into the digger shoe 200 during a casting process of the digger shoe 200. For instance, the ceramic material 206 may be introduced into a casting mold (e.g., an investment casting mold or a sand casting mold) and held in place by a retaining structure (e.g., wire mesh, woven fabric/fibers, metal or ceramic cage), by an adhesive, or the ceramic material 206 may comprise loose ceramic particles that merely rest on a surface of the mold. A molten metal, such as those discussed above, may be introduced into the casting mold and may permeate the interstitial spaces between the ceramic particles, enclosing the ceramic particles. These and other features of the operations of casting the lifting member are discussed in greater detail below with regard to FIG. 10.

In some examples, integrally forming the composite region 204 into the digger shoe 200 may provide a seamless transition from the composite region 204 to other regions of the digger shoe 200 that are not the composite region 204, such that a structural integrity of the digger shoe 200 is maintained throughout the digger shoe 200.

In some embodiments, the composite region 204 may be disposed, or at least partially disposed, along an outer sidewall 210 of the digger shoe 200. The composite region 204 may extend along the entire outer sidewall 210 from the first end to the second end or the composite region 204 may be disposed along only a portion of the outer sidewall 210. For instance, the composite region 204 may extend along a section of the outer sidewall 210 comprising about 20%, 30%, 40%, 50%, 60%, 70%, 80%, or 90% of the outer sidewall 208. The composite region 204 may comprise a single section of the lifting member or the composite region 204 may comprise multiple sections of the lifting member spaced apart at different locations, e.g., along the outer sidewall 210, of the lifting member. The composite region 204 may extend along a portion of the outer sidewall 208 that adjoins an opening, or channel 212, at one end of the digger shoe 200 for scooping the grinding media/raw material mixture.

In some examples, the composite region 202 may comprise a corner 214 where the outer sidewall 210 and the channel 212 adjoin. Curved lines 218 shown emanating from the corner 214 illustrate different embodiments of a location of a terminating edge of the composite region 202 at the corner 214. Furthermore, lines 220 illustrate different embodiments of a terminating edge of the composite region 202 extending into the shovel or channel 212 of the digger shoe 200. Lines 222 illustrate different embodiments of a terminating edge of the composite region 202 extending from the outer sidewall 210 into the body of the digger shoe 200. In some examples, the compsite region 202 may have a thickness of about 3 inches, about 2 inches, about 1 inch, about 0.5 inches, about 4 inches, about 5 inches, or within a range of the aforementioned thickness.

In some embodiments, the composite region 204 may comprise multiple sub-composite regions, each sub-composite region comprising any of the embodiments of composite region 204 described above. The sub-composite regions may be formed simultaneously, sequentially, in adjacent regions of the digger shoe 200, and/or in spaced apart areas of the digger shoe 200

Figure 3A:
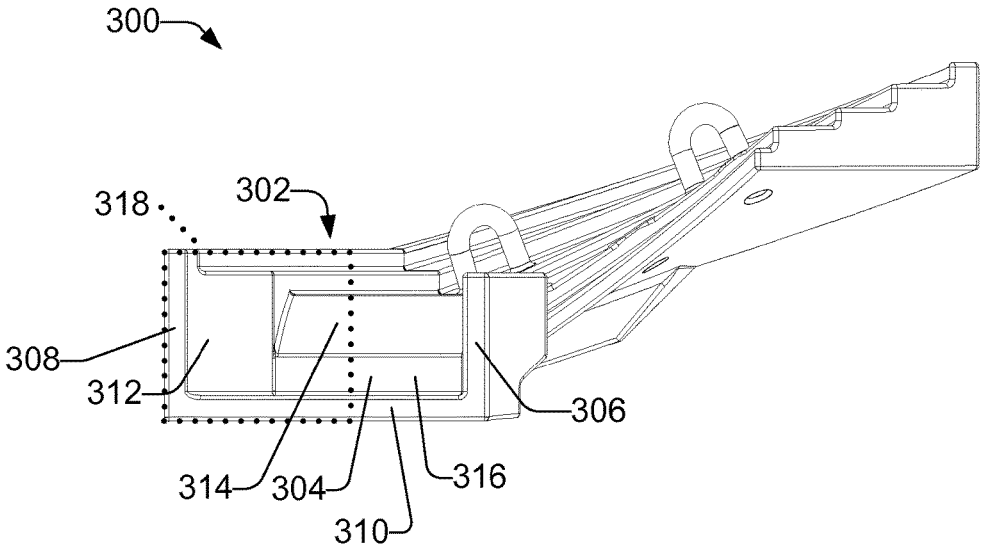
FIG. 3A illustrates a front view of an example digger shoe with a shovel portion and a support bar.

FIG. 3A illustrates a lifting element, such as a digger shoe 300, comprising a channel 302 disposed at the first end. The channel 302 may have an opening 304 defined by an inner sidewall terminating edge 306, an outer sidewall terminating edge 308, and a bottom surface terminating edge 310. Additional surfaces may form a shape of the channel 300 beyond the opening 304. For instance, a first slanted surface 312, oriented vertically, may extend from the outer sidewall at an angle into the channel 300. A second slanted surface 314 may extend from the bottom surface of the channel 300 and slant up into the body of the digger shoe 200. In some examples, an intermediate vertical surface 316 may be disposed between the second slanted surface 314 and the bottom surface of the channel 300. The first slanted surface 312, the second slanted surface 314, and/or the intermediate vertical surface 316 may provide a path to guide material scooped by the channel 302 onto the body of the digger shoe 300.

In some instances, a composite region may include all of or a portion of the channel 300, as illustrated above with regard to FIG. 2. For example, the outer sidewall terminating edge 308 and/or the first slanted surface 312 may constitute a portion of the composite region. Additionally or alternatively, some or all of the bottom surface terminating edge 314 may constitute the composite region. In some embodiments, the composite region may be formed into an outer half 318 of the channel 302 including the outer sidewall, some or all of the first slanted surface 312, and at least a portion of the bottom surface terminating edge 310, the second slanted surface 314, and/or the intermediate vertical surface 316. In other examples, the composite region may be formed into more than the outer half 318 of the channel 302. For instance, the composite region may span from the outer sidewall to the inner sidewall of the channel 302 and may include the outer sidewall and/or the inner sidewall. In some embodiments, there may be other configurations of the composite region at the channel 302. In some examples, the channel 302 or portions of the channel 302 may have increased wear resistance due to inclusion of the composite region.

Figure 3B:
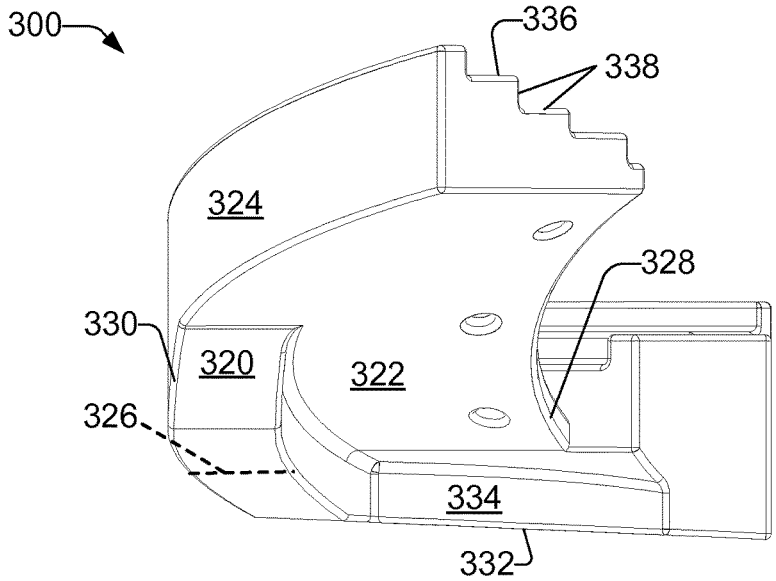
FIG. 3B illustrates a rear view of an example digger show with a shovel portion and a support bar.

FIG. 3B illustrates a rear elevation view of the digger shoe 300. The digger shoe 300 may comprise a support bar 320 protruding from a bottom surface 322 of the digger shoe 316. The support bar 320, which may be formed integrally into the digger shoe 300 during a casting process, may be disposed along an outer sidewall 324 with a thickness 326 extending from the outer sidewall 324 towards an inner sidewall 328. The thickness 326 may comprise a quarter of a distance to the inner sidewall 328, a third of the distance to the inner sidewall 328, a half of the distance to the inner sidewall 328, or a two-thirds of the distance to the inner sidewall 328. The support bar 320 may comprise a side 330 that is flush with the outer sidewall 324. The support bar 320 may extend along a portion of the body towards a first end 332, and may transition into a bottom surface of the channel 300, forming an additional thickness 334 below the bottom surface. In some instances, the support bar 320 may extend along about two-thirds of the outer sidewall 324. In other instances, the support bar 320 may extend along the entire outer sidewall 324, about three-quarters of the outer sidewall 324, about half of the outer sidewall 324, or about one-third of the outer sidewall 324. In some examples, the composite region may be disposed in discrete portions of or all of the support bar 320.

In some examples, a top surface 336 of the digger shoe 300 may comprise a stepped profile 338. In other words, the top surface 336 may comprise a shape of multiple tiers, formed by flat surfaces adjoined at right angles. The multiple tiers may each have a curve running parallel to a curve of the outer sidewall 324 and/or the inner sidewall 328. In some instances, one or more of the tiers may extend to the outer sidewall terminating edge. In some examples, a hook or loop may extend from the top surface, as discussed below.

Figure 4A:
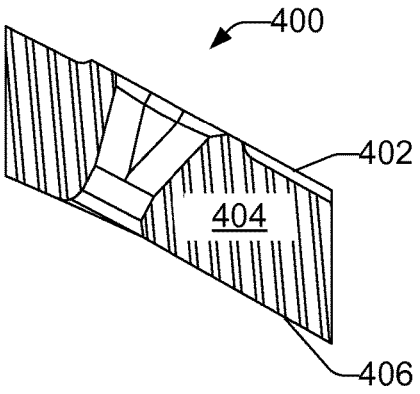
FIG. 4A illustrates a cross-sectional side view of an example mounting hole that may be formed into a cast lifting member.
Figure 4B:
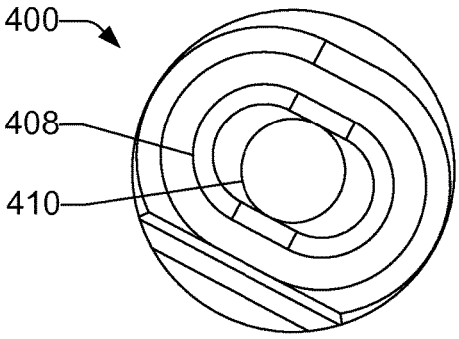
FIG. 4B illustrates a top view of an example mounting hole that may be formed into a cast lifting member.
Figure 4C:
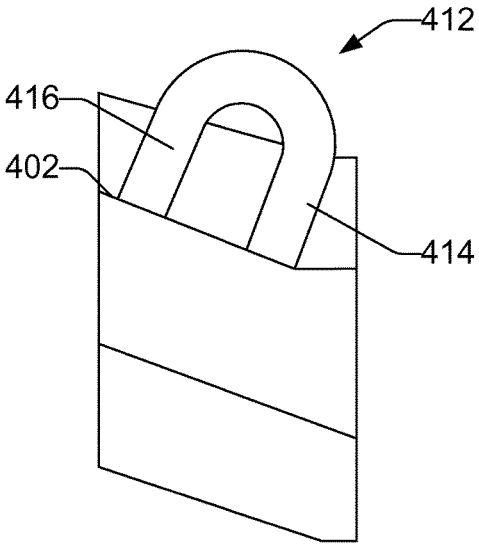
FIG. 4C illustrates a cross-sectional side view of an example hoop that may be formed into or attached to a cast lifting member.

FIGS. 4A-4C illustrate example features that may be disposed on the digger shoe. For instance, FIGS. 4A (cross-sectional side view) and 4B (top view) illustrate a mounting hole 400 which may pass from a top surface 402 of the digger shoe, through a thickness 404 of the digger shoe, to a bottom surface 406 of the digger shoe. The mounting hole 400 may comprise an elliptical opening 408 at the top surface 402, which transitions into a circular opening 410 at the bottom surface 406. In some instances, the mounting hole 400 may be configured to receive a bolt, which may pass through the mounting hole 400 to attach the digger shoe onto a surface of the vertical screw shaft.

FIG. 4C illustrates a hoop 412 that may protrude from the top surface 402. The hoop 412, which may comprise a first post 414 and a second post 416 that extend from the top surface 402 and adjoin above the top surface 402, may be integrally formed into the digger shoe during casting, or the hoop 412 may be attached to the top surface 402 of the digger shoe after casting (e.g., by welding). The hoop 412 may comprise a strength and rigidity to support an entire weight of the digger shoe (which may be between about 500 lbs. and 2,000 lbs.) during an installation and/or removal of the digger shoe.

Figure 5:
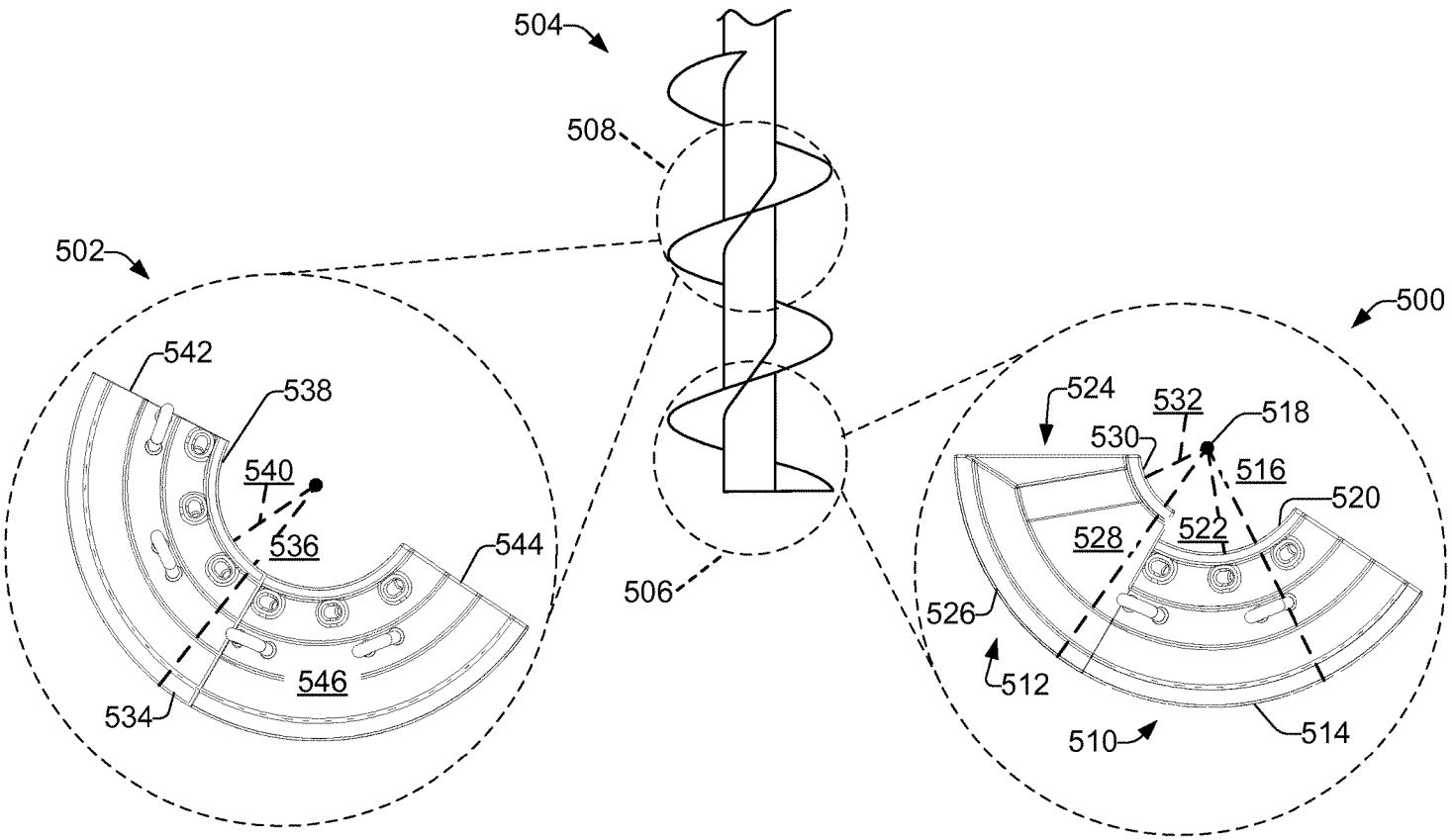
FIG. 5 illustrates a front view of a portion of an example vertical screw-shaft and top views of an example digger shoe and an example flight liner that may mount onto the vertical screw shaft.

FIG. 5 shows a top view of an example digger shoe 500, a top view of a flight liner 502, and a schematic representation of a vertical screw shaft 504. FIG. 5 also illustrates a mounting location 506 of the digger shoe 500 on the vertical screw shaft 504 and a mounting location 508 of the flight liner 502 on the vertical screw shaft 504.

In some instances, the digger shoe 500 may comprise a first portion 510 that transitions into a second portion 512. For instance, the first portion 510 may include the stepped profile, the plurality of mounting holes, and/or a plurality of hoops, as discussed above with regard to FIGS. 3B-4C. The first portion 510 may comprise an outer sidewall 514 with a curve having a first radius 516 with respect to an axis defined by a center line 518 of the vertical screw shaft 504 (in the top views, the center line 518 is illustrated going into the page). The first portion 510 may comprise an inner sidewall 520 with a curve having a second radius 522 with respect to the axis, which is less than the first radius 520.

The second portion 512 may include a channel 524 formed by multiple terminating edges of the digger shoe 500, as discussed above with regard to FIG. 3A. The channel 524 may form a scoop or shovel on the digger shoe 500. The second portion 512 may comprise an outer sidewall 526 that may be flush with the outer sidewall 514 of the first portion 510 (i.e., the outer sidewall 526 of the second portion 512 may have a curve with a first radius 528 that is substantially the same as the first radius 516 of the first portion 510). The second portion 512 may comprise an inner sidewall 530 with a curve having a second radius 532. The second radius 532 of the second portion 512 may be greater than the second radius 522 of the first portion 510. In other words, the second portion 512 may have a width (i.e., distance between the outer sidewall 526 and the inner sidewall 530) that is greater at the second portion 512 than at the first portion 510.

In some examples, the lifting member may comprise the flight liner 502. The flight liner 502 may mount onto the vertical screw shaft 504 at the mounting location 508 above the mounting location 506 of the digger shoe 500. For instance, the mounting location 506 of the digger shoe 500 may be at a bottom portion or end of the vertical screw shaft 504. The mounting location 508 of the flight liner 502 may be at a middle portion of the vertical screw shaft 504. The mounting location 508 of the flight liner 502 may be above and directly adjacent to the mounting location 506 of the digger shoe 500, or the mounting location 508 of the flight liner 502 may be above and spaced apart from the mounting location 506 of the digger shoe 500. In some instances, multiple flight liners may be mounted to the vertical screw shaft 504 to line and protect all or nearly all of the vertical screw shaft 504 except a portion comprising the mounted digger shoe 500.

In some embodiments, the flight liner 502 may comprise an outer sidewall 534 having a curve with a first radius 536 and an inner sidewall 538 having a curve with a second radius 540, which is less than the first radius 534 of the outer sidewall 534. The second radius 540 may be substantially constant from a first end 542 of the flight liner 502 to a second end 544 of the flight liner 502. In some examples, the flight liner 502 may comprise a top surface 546, which may comprise any or all of the features described above with regard to the top surface of the digger shoe 500 (e.g., the stepped profile, the plurality of mounting holes, and/or the plurality of hoops, as discussed above with regard to FIGS. 3B-4C). In some examples, the flight liner 502 may comprise a structure substantially similar to the first portion 510 of the digger shoe 500, an extended first portion 510 of the digger shoe 500, and/or multiple first portions 510 of the digger shoe 500 connected together or formed integrally together.

In some examples, the flight liner 502 may include the composite region. The composite region may be disposed at least at the outer sidewall 534, at portions of the outer sidewall 534, or the composite region 314 may have any of the other configurations discussed above with regard to the flight liner 502.

Illustrative Composite Component for Horizontal Axis Mill

Figure 6:
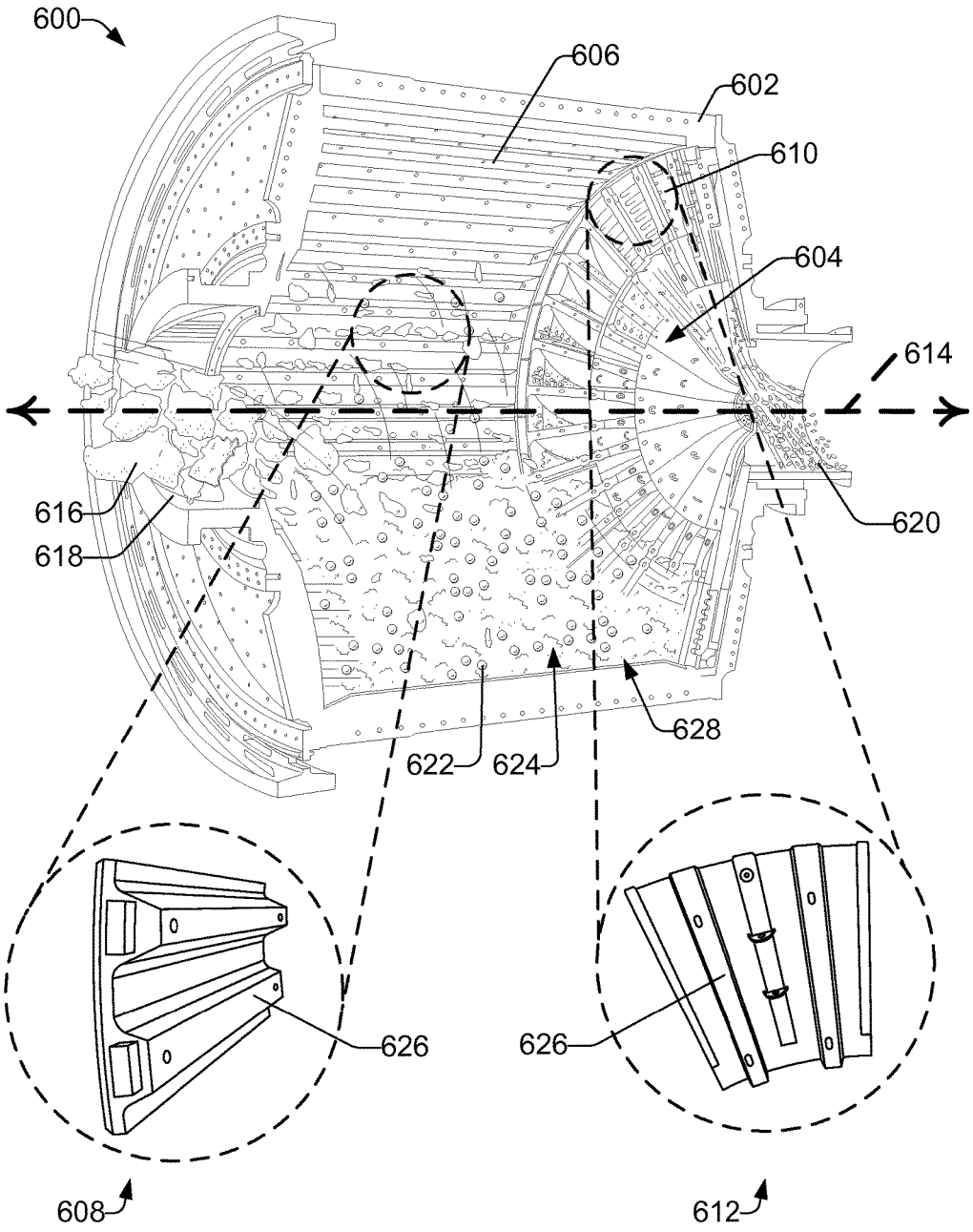
FIG. 6 illustrates a perspective view of a cut-out portion of an example semi-autogenous grinding (SAG) mill and example lifting members, such as a shell liner and an end liner, that may mount onto the semi-autogenous grinding mill.

FIG. 6 is a cut-out perspective view illustrating an example horizontal axis mill such as a Semi-Autogenous Grinding (SAG) mill 600. The SAG mill 600 may comprise a housing 602 that encloses an interior space 604. An inner side surface 606 of the SAG mill 600 may include a lifting member or multiple lifting members, such as a shell liner 608. An inner end surface 610 of the SAG mill 600 may include an end lifting member or multiple lifting members, such as an end liner 612. Although this section and other sections of this application may describe features that may be implemented with the SAG mill 600, any of the features described in this section or application could be implemented in other horizontal axis mills, such as an autogenous mill (auto), rod mill, or a ball mill.

In some embodiments, during operation, the housing 604 of the SAG mill 600 may rotate about a horizontal axis 614. Raw material 616 may enter the interior space 604 of the housing 602 through an inlet 618 at a first end of the housing 602 and, after being milled and reduced in size, may exit the housing 602 through an outlet 620 at a second end of the housing 602. The raw material 616 may mix with a grinding media 622 to form a raw material/grinding media mixture 624 in the interior space 604 of the SAG mill 600. Alternatively, (e.g., in implementations comprising an auto mill), the raw material 616 may not be mixed with a grinding media. Rather, the raw material 616 itself may provide the collisions to break the raw material 616 apart. As the housing 602 rotates, a lifting bar 626 protruding from the lifting members (e.g., shell liner 608 and/or end liner 612) may scoop or lift some of the raw material/grinding media mixture 624 (or merely the raw material 616) from a bottom portion 628 of the SAG mill 600.

For instance, the raw material/grinding media mixture 624 may be disposed in the bottom portion 628 of the SAG mill 600 prior to and/or during operation. As the housing 602 rotates, some of the raw material/grinding media mixture 624 may get caught in a space above the lifting bar 626 or a gap between the lifting bar 624 and other lifting bars of the lifting members rotating through the bottom portion 628 of the SAG mill 600. The lifting members may rotate from a location at the bottom portion 628 of the SAG mill 600 to a location at a first side of the SAG mill 600, to a location at a top of the SAG mill 600, to a location at a second side of the SAG mill 600 opposite the first side, and then back to the location at the bottom portion 628 of the SAG mill 600, making a complete rotation of 360° about the horizontal axis. During operation of the SAG mill 600, the housing 602 may make multiple rotations in succession.

In some examples, the rotation of the housing 602 may elevate the raw material/grinding media mixture 624 from the bottom portion 628 and cause the raw material/grinding media mixture 624 to fall back to the bottom portion 628 of the SAG mill 600. For instance, as one of the lifting members 608 and/or 612 rotates from the location at the side of the SAG mill 600 to the location at the top of the SAG mill 600, the raw material/grinding media mixture 624 captured by the lifting bar 626 may slide off the lifting bar 626 and fall back to the bottom portion 628 of the SAG mill 600. Multiple collisions between the raw material 616 and the grinding media 622 may occur during the rotation of the housing 602 and the continuous elevating and falling of the raw material/grinding media mixture 624 back and forth from the bottom portion 628 of the SAG mill 600 to the side of the SAG mill 600.

Although the multiple collisions are needed to grind the raw material 616, multiple collisions may also occur between the raw material/grinding media mixture 624 and one or more of the lifting member/s. Portions of the lifting member that experience a high amount of collisions may wear down faster than other portions of the lifting member. In some examples, the lifting member may comprise a composite region which may be disposed at a location on the shell liner 608 or the end liner 612 that experiences higher amounts of wear from the multiple collisions than other locations on the side shell 608 liner or end liner 612 in order to limit or reduce the wear at these locations. In some embodiments, other components of the SAG mill may comprise the composite region, such as the inlet 618 (e.g., a feeder liner) and/or the outlet 620 (e.g., a discharge liner).

Figure 7:
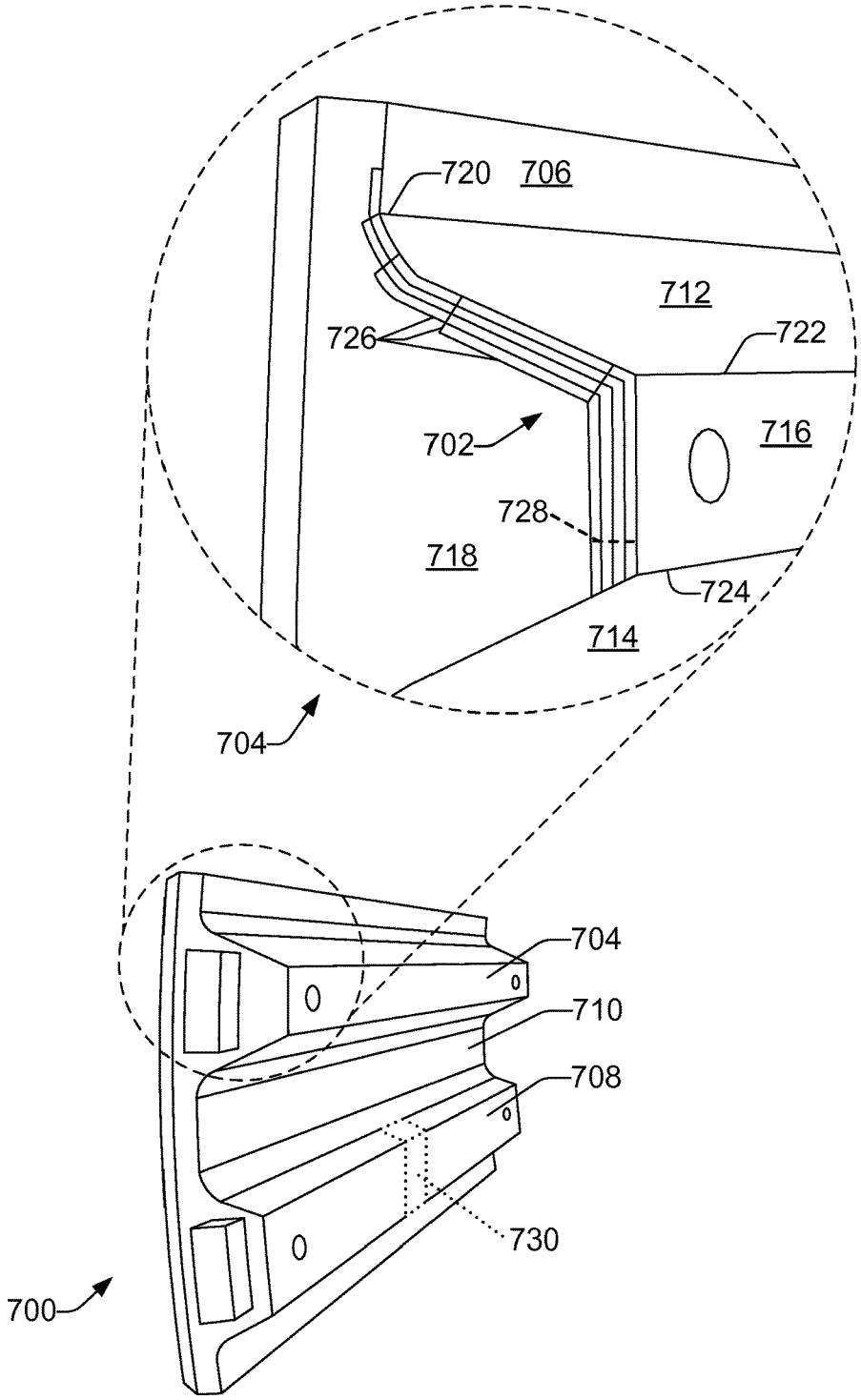
FIG. 7 illustrates a perspective view of an example shell liner with a composite region and multiple embodiments of the composite region.

FIG. 7 illustrates an example shell liner 700 lifting member with a composite region 702 formed into a first lifting bar 704 of the shell liner 700. As discussed above with regard to FIG. 2 the composite region 702 may be integrally formed into the shell liner 700 during a casting process, or the composite region 702 may be formed separately and then be attached to the shell liner 700 during or after the casting process. For instance, the composite region 702 may be cast into the first lifting bar 704, which may be bolted to the shell liner 700, or the lifting bar 704, the shell liner 700, and the composite region may be formed as a single cast piece formed during the casting process.

In some embodiments, the first lifting bar 704 may protrude from an inner surface 706 (i.e., a surface that faces the interior space of the mill when the shell liner 700 is installed in the mill) of the shell liner 700. The shell liner 700 may comprise one lifting bar 704 or multiple lifting bars, such as a second lifting bar 708. The second lifting bar 708 may be substantially the same as the first lifting bar 704 in shape, size, and/or composition, or the second lifting bar 708 may be substantially different than the first lifting bar 704 in shape, size, and/or composition. A channel 710 may be formed in a space between the multiple lifting bars 704 and 708.

In some embodiments, the lifting bar 704 may comprise a leading surface 712 extending from the inner surface 706 and a trailing surface 714 extending into the inner surface 706. The lifting bar 704 may comprise an end surface 716 disposed between the leading surface 712 and the trailing surface 714. For instance, the leading surface 712, the trailing surface 714, and the end surface 716 of the lifting bar 706 may form a cross-section of the lifting bar 704 which may comprise a substantially trapezoidal cross-section 718, as shown in FIG. 7. In other examples, the lifting bar 704 may comprise a substantially rectangular cross section formed by the leading surface 712, the trailing surface 714, and the end surface 716. In some examples, the lifting bar 704 may comprise the leading surface 712 transitioning directly into the trailing surface 714 without any end surface 716 (e.g., the lifting bar 704 may comprise a triangular cross-section), or the lifting bar 704 may have other cross-section configurations, which are discussed in greater detail below with regard to FIGS. 9A-9D.

In some examples, the composite region 702 may be at least partially formed into the lifting bar 704. For instance, ceramic material may be embedded into a metal of the lifting bar 704 in at least a portion of the leading surface 712, the trailing surface 714, the end surface 716, and/or combinations thereof. Additionally or alternatively, ceramic material may be embedded into at least a portion of the channel 710. Ceramic material may be embedded into any parts of the shell liner 700 discussed above, combinations thereof, or the entire shell liner 700.

In some embodiments, the composite region 702 may be disposed at a portion of the shell liner 700 that experiences the most wear from the raw material/grinding media mixture collisions relative to other portions of the shell liner 700. In some examples, the composite region 702 may have a first end proximate to a transition point 720 on the shell liner 700 where the leading surface 712 begins to protrude from the shell liner 700. For instance, the composite region 702 may have the first end in the channel 710, at the transition point 720, or at the leading surface 714 spaced apart from the transition point 714.

In some examples, the composite region 702 may extend from the first end to the leading surface 712 and/or to the end surface 716. The composite region 702 may terminate at the end surface 716 or the composite region 702 may wrap around a first corner 722 of the end surface 716 (i.e., where the leading surface 712 transitions into the end surface 716) and extend partially or entirely down the end surface 716 to a second corner 724 of the end surface 716 (i.e., where the end surface 716 transitions into the trailing surface 714). Lines 726 illustrate multiple embodiments of a location of the first end (or multiple staggered first ends) of the composite region 702, and a location of a thickness (or multiple thicknesses) of the composite region 702 into the cross-section 718. Multiple configurations of the composite region 702 using any of the lines 726 and/or combinations of the lines 726 may be implemented.

In some embodiments, the composite region 702 may comprise a layer of ceramic embedded in metal that extends along a contour of the channel 710, the leading surface 712, the trailing surface 714, the end surface 716, and/or combinations thereof. The composite region 702 may have a thickness 728 that may vary at different locations on the shell liner 700 or the composite region 702 may have a constant thickness 728 as it runs along contours of the shell liner 700. In some examples, the composite region 702 may have two or more different stepped thicknesses 728 that run along contours of the shell liner 700. In some examples, each layers, section, and/or thickness 728 of the shell liner 700 and/or lifting bar 704, may comprise a different type of ceramic, the same type of ceramic, or various combinations of ceramic types. The lines 726 illustrate multiple example boundary lines of the composite region 702 or multiple layers of the composite region 702

For instance, a first layer may comprise a first ceramic particle slurry comprising ceramic particles with an average diameter of 0.1-0.5 mm, 0.5-1 mm, 1-2 mm, 2-4 mm, 5-10 mm, 10-20 mm, 20-50 mm. A second layer, third layer, and/or fourth layer may comprise a second ceramic particle slurry comprising ceramic particles with an average diameter of one of the aforementioned ranges that is the same as the first layer, or one of the aforementioned ranges that is different than the first layer.

The first layer of the composite region may comprise one of $Al_2O_3$, ZnO, $TiO_2$, FeO, $Fe_2O_3$, $SiO_2$, $ZrO_2$, $CrO_3$, $Cr_2O_3$, $B_2O_3$, $MoO_3$ $V_2O_5$, CuO, MgO, NiO, WC, TiC, SiC, $B_4C$, BN and/or $Si_3N_4$. The second layer, third layer and/or fourth layer may comprise one of the aforementioned compounds that is the same as the first layer or that is different than the first layer.

In some embodiments, portions of the lifting bar 704 or 708, the entire lifting bar 704 or 708, or a cross-sectional segment 730 (or multiple cross-sectional segments 730) of the lifting bar 704 or 708 may comprise a layer or multiple layers of the composite region 702. Sections of the shell liner 700 comprising portions of the lifting bar 704 or 708 or comprising the entire lifting bar 704 or 708 and/or the channel/s 710 and/or other parts of the shell liner 700 may include the composite region 702.

In some examples, the composite region 702 may be disposed at locations on the shell liner 700 that hold the raw material/grinding media mixture and/or experience sliding and/or collisions with the raw material/grinding media mixture when the shell liner 700 rotates with the housing of the SAG mill. A surface of the lifting bar 704 facing the direction of rotation may comprise the composite region 702, e.g., the leading surface 712. In some examples, the raw material/grinding media mixture may fall into the channel 710 when the shell liner 700 is at the bottom of the housing rotation, and the raw material/grind media mixture may slide onto the leading surface 712 and fall off the transition 722 of the leading surface 712 to the end surface 716 or trailing surface 714 when the shell liner 700 passes through a side portion of the rotation of the housing, which may cause wear on some or all portions of the leading surface 712, end surface 716, and/or the transition 722.

In some examples, the composite region 702 may enhance a wear-resistance of portions of the shell liner 700 that experience wear from the sliding and collisions of the raw mixture/grinding media mixture by increasing an aggregate hardness of parts of the shell liner 700. For instance, the ceramic material may have a greater hardness than the metal alloy (e.g., steel alloys, cast iron, white iron, high chrome iron, FeMnAl alloys, aluminum alloys) encapsulating the ceramic material, such that a hardness (e.g., Vicker Pyramid number, Brinell hardness number, etc.) of the composite region 702 is greater than a hardness of the metal (or portions of the shell liner 700) without ceramic material.

Figures 8A, 8B, 8C:
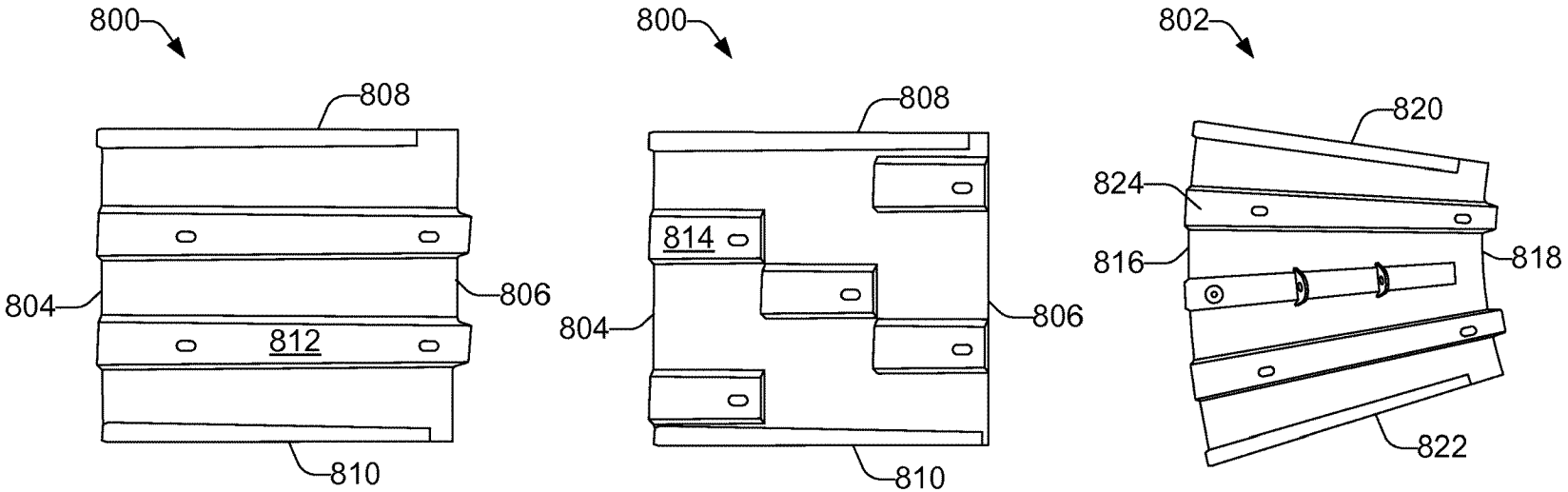
FIG. 8A illustrates a perspective view of an example shell liner.
FIG. 8B illustrates a perspective view of an example shell liner.
FIG. 8C illustrates a perspective view of an example end liner.

FIGS. 8A and 8B illustrate example embodiments of a shell liner 800 and FIG. 8C illustrates an example embodiment of an end liner 802. As shown in FIGS. 8A and 8B, the shell liner 800 may form a substantially square or rectangular front profile including a first side 804, a second side 806, a top 808, and a bottom 810. The shell liner 800 may comprise a lifting bar 812 running substantially parallel to the top 808 and/or the bottom 810. The lifting bar 812 may extend from the first side 804 to the second side 806, as shown in FIG. 8A. As shown FIG. 8B, the lifting bar 812 may comprise a lifting bar segment 814 which may be adjacent to the first side 804, located at a center location on the shell liner 800 not adjacent to any sides 804, 806, 808, or 810, adjacent to the second side 806, adjacent to the top 808, and/or adjacent to the bottom 810.

In some examples, the shell liner 800 may comprise one or multiple lifting bar/s 812. The lifting bar/s 812 may comprise the composite region or portions of the composite region, as discussed above with regard to FIGS. 6 and 7.

FIG. 8C illustrates the example end liner 802 comprising an annular sector (e.g., rounded wedge) shaped front profile. For instance, the end liner may comprise a first curved side 816 and a second curved side 818 having a radius that shares an origin with a radius of the first curved side 816 (in other words, the first curved side 816 may be "parallel" to the second curved side 818). The end liner 802 may comprise a top side 820 that may comprise a straight edge, and a bottom side 822 that may comprise a straight edge. The top side 802 and/or the bottom side 822 may extend in a direction perpendicular to the curves of the first curved side 816 and/or the second curved side 818.

In some instances, the end liner may 802 comprise a lifting bar or multiple lifting bars 824 that may extend from the first curved side 816 to the second curved side 818. The lifting bar/s 824 may have a lateral dimension perpendicular to a curve of the first curved side 816 and/or the second curved side 818. The lift bar/s 824 may span an entire width of the end liner 802, similar to those discussed with regard to FIG. 8A, or the lifting bar/s may comprise only a segment, similar to those discussed with regard to FIG. 8B. Additionally or alternatively, the lifting bar/s 824 may comprise any of the other lifting bar features discussed above with regard to FIGS. 6-8B. The composite region may be disposed in a portion or multiple portions of the shell liner 800, the end liner 802, and/or lifting bar/s 812, 814, and 824, as discussed with regard to FIGS. 6 and 7.

FIGS. 9A-9D illustrate multiple example cross-sections and cross-sectional features of a lifting member, i.e., the shell liner and/or the end liner of FIGS. 6-8C. Any of the features of the cross-sections discussed in FIGS. 9A-9D may be combined, duplicated, and/or omitted. Furthermore, other cross-sections that are not illustrated in FIGS. 9A-9D may be implemented as well, such as irregularly shaped cross-sections.

Figure 9A:
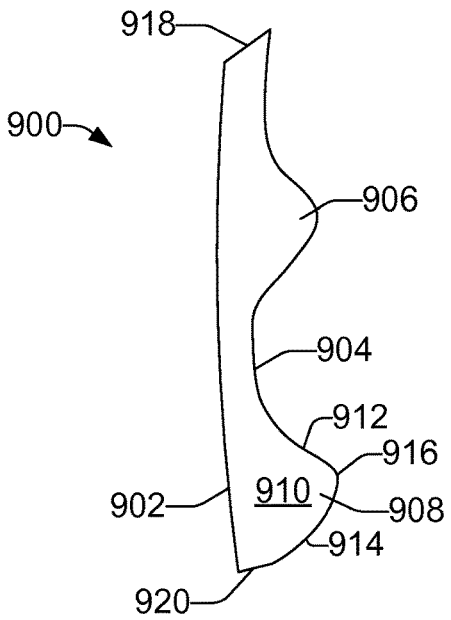
FIG. 9A illustrates a side view of an embodiment of a lifting member (e.g., a shell liner or an end liner) cross-section, of a lifting bar cross-section, and of a lifting bar configuration on the lifting member.

FIG. 9A illustrates an example shell liner 900 with a curved outer surface 902 and a curved inner surface 904. The shell liner 900 may comprise a first lifting bar 906 and a second lifting bar 908. The lifting bar/s 906 and/or 908 may comprise a wave-shaped cross-section 910. The wave-shaped cross section may have a leading surface 912 that transitions into a trailing surface 914 with a sharp edge at a transition point 916 or a rounded edge at the transition point 916. In some examples, the leading surface 912 and/or the trailing surface 914 may comprise a convex curve, a concave curve, or combinations thereof. For instance, the leading surface 912 may comprise a concave curve and the trailing surface 914 may comprise a convex curve. The trailing surface 914 and/or the leading surface 912 may comprise an inflection point that transitions a convex curve into a concave curve.

In some examples, the shell liner 900 may comprise a top end 918 that slants between the curved outer surface 902 and the curved inner surface 904 (e.g., is non-perpendicular to the curved outer surface 902 and the curved inner surface). In some embodiments, at least one of the first or second lifting bar/s 906 and/or 908 may be disposed between the top end 918 and a bottom end 920 proximate to a center between the top and bottom ends 918 and 920. In some examples, at least one of the first or second lifting bar/s 906 and/or 908 may be disposed adjacent to the top end 918 or the bottom end 908.

Figure 9B:
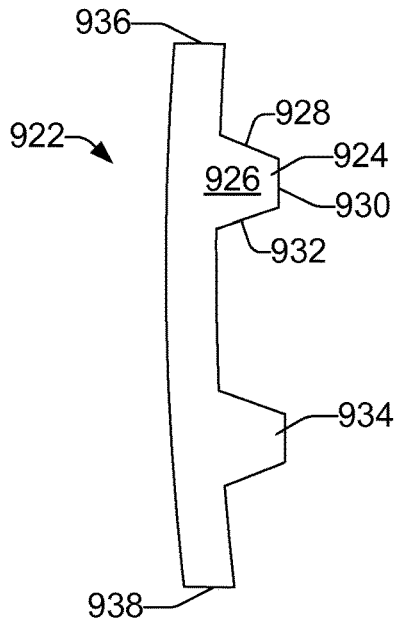
FIG. 9B illustrates a side view of an embodiment of a lifting member (e.g., a shell liner or an end liner) cross-section, of a lifting bar cross-section, and of a lifting bar configuration on the lifting member.

FIG. 9B illustrates an example shell liner 922 comprising a first lifting bar 924 with a trapezoidal cross section 926. For instance, a substantially straight leading surface 928 may connect to a substantially straight end surface 930 at an obtuse angle, which may connect to a trailing surface 932 at an obtuse angle. In some examples, the shell liner 922 may comprise the first lifting bar 924 and a second lifting bar 934. The first and second lifting bars 924 and 934 may be spaced a distance apart from a top end 936 and a bottom end 938 of the shell liner 922, respectively. In some examples, the top end 936 and/or the bottom end may comprise a straight edge 938 that extends substantially perpendicularly from the outer surface to the inner surface of the shell liner 922.

Figure 9C:
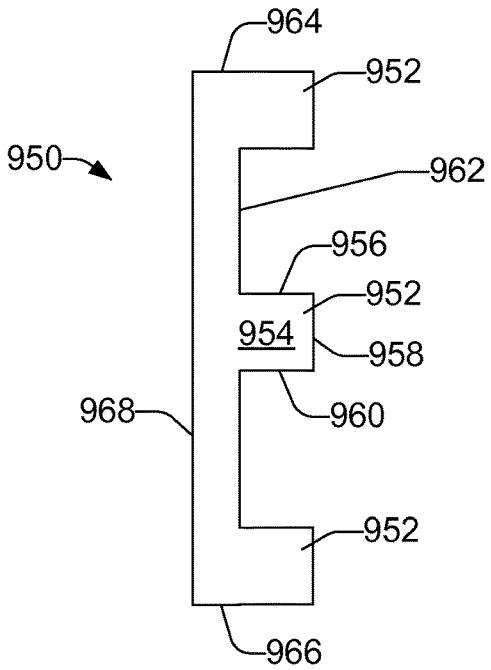
FIG. 9C illustrates a side view of an embodiment of a lifting member (e.g., a shell liner or an end liner) cross-section, of a lifting bar cross-section, and of a lifting bar configuration on the lifting member.

FIG. 9C illustrates an example shell liner 950 comprising one or multiple lifting bars 952 having a substantially square or rectangular cross section 954. For instance the lifting bar 952 may comprise a substantially straight leading surface 956 that perpendicularly connects to a substantially straight end surface 958, which perpendicularly connects to a substantially straight trailing surface 960. In some examples, one or multiple of the lifting bar/s 952 of the shell liner 950 may protrude from an inner surface 962 of the shell liner 950 at a location adjacent to a top end 964 and/or a bottom end 966. In some examples, the lifting bar 952 may be located at a location equidistance from the top end 964 and the bottom end 966. In some embodiments, the shell liner 950 may comprise a flat (e.g., straight) outer surface 968 and/or the inner surface 962 may be flat. In some examples, the flat outer surface 968 may be substantially parallel to the flat inner surface 962.

Figure 9D:
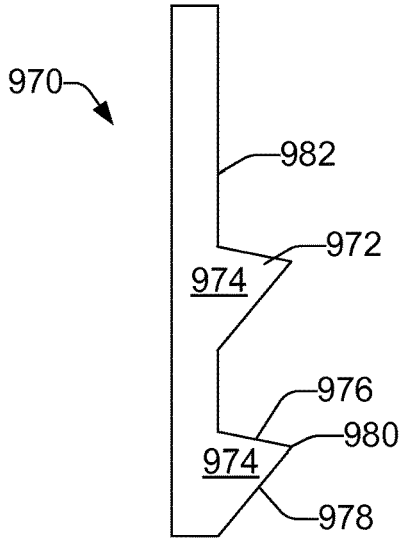
FIG. 9D illustrates a side view of an embodiment of a lifting member (e.g., a shell liner or an end liner) cross-section, of a lifting bar cross-section, and of a lifting bar configuration on the lifting member.

FIG. 9D illustrates an example shell liner 970 comprising one or multiple lifting bar/s 970 having a substantially triangular cross-section 972. The triangular cross-section 972 may be formed by a straight leading surface 976 that connects to a straight trailing surface 978 and forms an angle with the trailing surface 978 at a transition point 980 The straight leading surface 976 may comprise a dimension from an inner surface 982 of the shell liner 970 to the transition point 980 that is substantially the same as a dimension of the trailing surface 978 from the inner surface 982 to the transition point 980, such that the triangular cross-section 974 may comprise an equilateral or isosceles triangle. In other examples, the dimension of the straight leading surface 976 may be different than the dimension of the straight trailing surface 978, such that the triangular cross-section 974 may comprise a scalene triangle. In some examples, one or all of the lifting bar/s 972 may be disposed at a portion (e.g., a half) of the shell liner 968 and there may comprise other portions (e.g., another half) not comprising any lifting bar/s 972.

Illustrative Method of Manufacturing a Composite Milling Component

Figure 10:
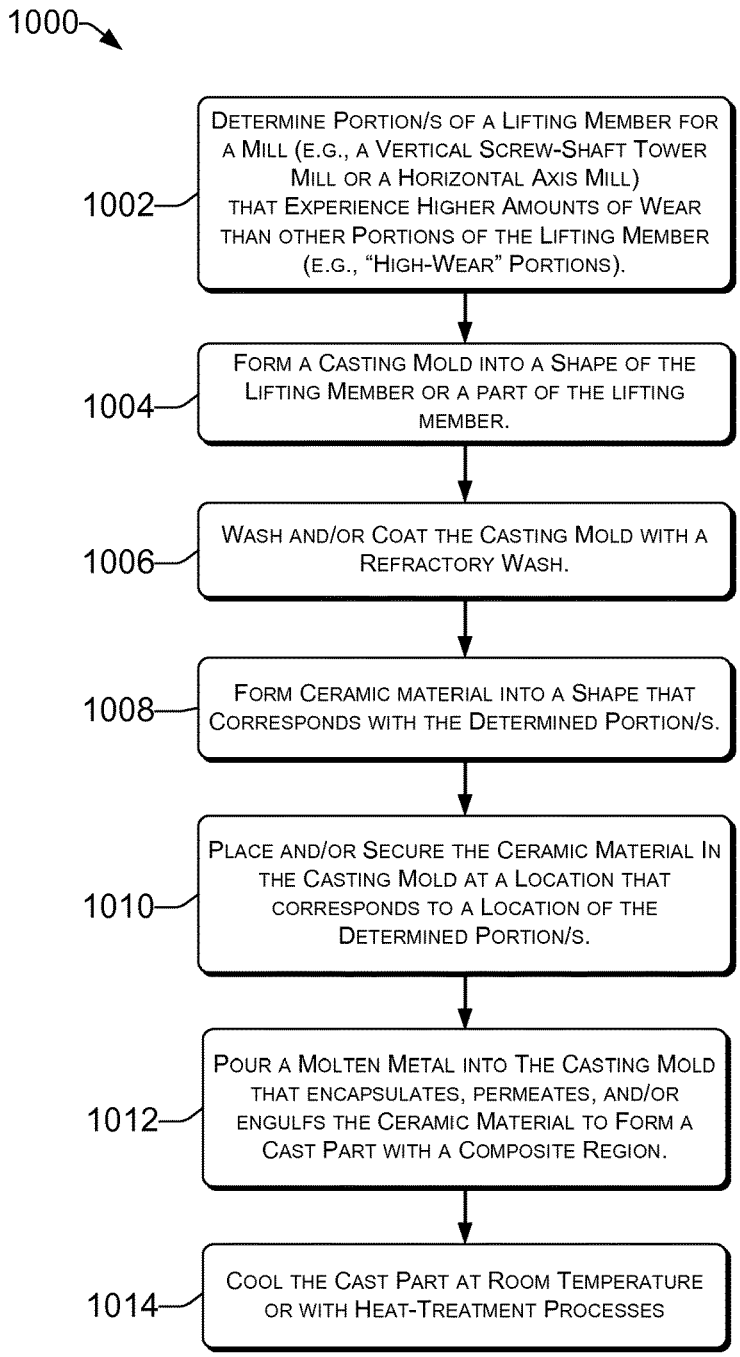
FIG. 10 illustrates a schematic representation of an example embodiment of a method of manufacturing a composite milling component.

FIG. 10 is a flow diagram illustrating an example method 1000 of manufacturing a composite milling component. For convenience, the method 1000 will be described with reference to composite milling components and mill systems incorporating composite milling components that are illustrated and described with respect to FIGS. 1-9D, but the method 1000 is not limited to use with these components or mill systems. While FIG. 10 illustrates an example order, the described operations in this and all other methods and processes described in this application may be performed in other orders and/or in parallel. Further, operations of the method 1000 may be omitted, repeated, and/or combined (e.g., performed simultaneous and/or comprise the same operation).

In some examples, the method 1000 may include operation 1002, where portion/s of a lifting member for a mill (e.g., a vertical screw-shaft tower mill, a SAG mill, a rod mill, or a ball mill) that experience higher amounts of wear than other portions of the lifting member is/are determined. For instance, a condition of a lifting member or multiple lifting members may be monitored during use. After a portion of the lifting member is identified as experiencing a greater amount of wear than other portions of the lifting member, e.g., by measuring with a measuring device (e.g., calipers or measuring tape) or by visual inspection of an operator, that/those portion/s may be determined to be "high-wear" portion/s of the lifting member. A location and/or shape of the high-wear portion may be determined e.g., with a measuring device and/or through visual inspection.

In some examples, the method 1000 may include operation 1004, where a casting mold is formed into a shape of the lifting member or a part of the lifting member. For instance, the lifting member may comprise a digger shoe and the cast mold may be formed into a shape of the digger shoe or a shape of part of the digger shoe, e.g., a part comprising the determined "high wear" portion/s. The casting mold may comprise a sand casting mold or an investment casting mold. The casting mold may comprise a cavity with a bottom surface having contours that correspond to contours of a bottom or a top of the lifting member to be cast, and side contours that correspond to contours of a side of the lifting member to be cast.

In some embodiments, the method 1000 may include operation 1006, where the casting mold is washed and coated with a refractory wash. The refractory wash may create a film that provides a smoother finish on the cast part. The refractory wash may provide a barrier layer which is not penetrable by a molten casting metal, preventing the molten casting metal from permeating the mold itself. The refractory wash may comprise a zircon wash, an alumina wash, and/or another wash.

In some examples, the method 1000 may include operation 1008, where the ceramic material is formed into a shape that corresponds to the determined "high-wear" portion/s. The forming may include placing a ceramic grit comprising a slurry of ceramic grains and adhesive onto surfaces of the mold at locations that correspond to locations of the determined portion/s, in which case operation 1008 would include operation 1010. Additionally or alternatively, loose ceramic particles may be held at a location in the mold cavity with a retaining structure e.g., a wire or fabric mesh, a ceramic mesh, a net, rods, and/or pins that fully or partially enclose the loose ceramic particles. Additionally or alternatively, operation 1008 may comprise forming a ceramic insert in a second mold shaped like the determined "high wear" portion/s, and then the ceramic insert my placed in the casting mold (i.e., operation 1008 may occur prior to operation 1010). In some examples, a ceramic insert may be formed by a ceramic 3D-printer and then placed in the casting mold. For instance, the 3D-printer may form a ceramic insert into a shape that corresponds to contours of the lifting member and/or contours of wear on the lifting member. In some instances, a ceramic retaining structure or a ceramic partition for positioning other ceramic material may be formed by the 3-D printer.

The method 1000 may include the operation 1010, where the ceramic material is placed and/or secured at the location in the casting mold (e.g., on an inner surface of the cavity of the casting mold) that corresponds with the location of the determined "high-wear" portion/s of the lifting member to be cast. As noted above, operation 1010 may occur contemporaneously with operation 1008, where the ceramic material is formed into a shape in the mold, or the operation 1010 may occur after operation 1008, where the ceramic material is formed prior to being placed and/or secured in the mold. In some examples, operations and/or operation 1010 may occur iteratively, i.e., multiple times, to place multiple ceramics in the mold in multiple locations or in a same location to form multiple layers. Operations 1008 and/or 1010 may occur iteratively with a same type of formed ceramic shape or any combination of the formed ceramic shapes discussed above. For instance, a layer of ceramic grit may coat a first portion of the mold and a preformed ceramic insert may be placed in a second portion of the mold. The second portion of the mold may be entirely separate from the first portion or the second portion may overlap (partially or fully) with the first portion. There are many other combinations of types of ceramic material, layers of ceramic material, and/or locations of ceramic material that could be implemented.

The method 1000 may include operation 1012, where a molten metal is poured into the casting mold and encapsulates, permeates, and/or engulfs the ceramic material (as well as any retaining structures or other structures located in the mold cavity) to form a cast part with a composite region including the encapsulated, permeated, and/or engulfed ceramic particles. In some examples, the ceramic material may be preheated prior to the pouring. In some embodiments, operation 1012 may be combined with operation 1010. For instance, the ceramic material may comprise loose ceramic grains that are poured into the mold contemporaneously with the molten metal. Additionally or alternatively, the ceramic material may have a predetermined density and buoyancy relative to the molten metal, which positions the ceramic material in a location of the mold. For instance, the ceramic material may float or sink to a location of the mold to form the composite region at that location.

The method 1000 may include operation 1014, where the cast lifting member is cooled at room temperature or with one or more heat-treatment process/es. For instance, the cast lifting member may be subjected to quenching, annealing, tempering, austempering, cryogenic hardening, and/or combinations thereof. In some examples, the one or more heat-treatment process/es may implement a phase change in the metal to provide wear resistant characteristics, and/or may provide an ability to vary the wear resistant characteristics for specific applications. The heat treatment process may reduce internal stress in the composite region of the lifting component due to different coefficients of thermal expansion of the metal and the ceramic material, thereby reducing cracking or voids in the composite region.

CONCLUSION

Although this disclosure uses language specific to structural features and/or methodological acts, it is to be understood that the scope of the disclosure is not necessarily limited to the specific features or acts described. Rather, the specific features and acts are disclosed as illustrative forms of implementation.

What is claimed is:

1. A cast component comprising:

a body comprising a substantially helical shape about an axis with a first end terminating at a first plane and a second end terminating at a second plane;

the first plane forming an angle with the second plane, with a vertex at the axis, of between about 90° and about 180°;

the body including a composite region, disposed at an outer portion of the body, having an aggregate hardness greater than a hardness of portions of the body not including the composite region, wherein the cast component comprises a digger shoe or a flight liner of a tower mill.

2. The cast component of claim 1, wherein the body comprises a curved inner sidewall and a curved outer sidewall, a distance between the curved inner sidewall and the curved outer sidewall being greater at the first end than at the second end.

3. The cast component of claim 1, further comprising a top surface disposed between the first end and the second end, the top surface having a stepped profile.

4. The cast component of claim 1, further comprising a top surface disposed between the first end and the second end, a bottom surface disposed between the first end and the second end, and a mounting hole passing from the top surface to the bottom surface.

5. The cast component of claim 1, further comprising a top surface disposed between the first end and the second end, and one or more loops or hooks protruding from the top surface.

6. The cast component of claim 1, further comprising a bottom surface disposed between the first end and the second end, and a support bar protruding from the bottom surface proximal to an outer sidewall of the body.

7. The cast component of claim 1, further comprising a channel disposed at the first end, formed by a terminating edge of a bottom surface, a terminating edge of an inner sidewall, and a terminating edge of an outer sidewall.

8. The cast component of claim 1, wherein the composite region is integrally formed into the body.

9. The cast component of claim 1, wherein the cast component is mountable onto a vertical screw shaft of a tower mill.

10. A tower mill comprising:

a screw shaft; and a cast component mounted to the screw shaft, the cast component comprising:

a body comprising a substantially helical shape about an axis with a first end terminating at a first plane and a second end terminating at a second plane;

the first plane forming an angle with the second plane, with a vertex at the axis, of between about 90° and about 180°;

the body including a composite region, disposed at an outer portion of the body, having an aggregate hardness greater than a hardness of portions of the body not including the composite region.

11. The tower mill of claim 10, wherein the body of the cast component comprises a curved inner sidewall and a curved outer sidewall, a distance between the curved inner sidewall and the curved outer sidewall being greater at the first end than at the second end.

12. The tower mill of claim 10, the cast component further comprising a top surface disposed between the first end and the second end, the top surface having a stepped profile.

13. The tower mill of claim 10, the cast component further comprising a top surface disposed between the first end and the second end, a bottom surface disposed between the first end and the second end, and a mounting hole passing from the top surface to the bottom surface.

14. The tower mill of claim 10, the cast component further comprising a top surface disposed between the first end and the second end, and one or more loops or hooks protruding from the top surface.

15. The tower mill of claim 10, the cast component further comprising a bottom surface disposed between the first end and the second end, and a support bar protruding from the bottom surface proximal to an outer sidewall of the body.

16. The tower mill of claim 10, the cast component further comprising a channel disposed at the first end, formed by a terminating edge of a bottom surface, a terminating edge of an inner sidewall, and a terminating edge of an outer sidewall.

17. The tower mill of claim 10, wherein the composite region is integrally formed into the body.

18. The tower mill of claim 10, wherein the cast component comprises a digger shoe or a flight liner.

19. A cast component comprising:

a body comprising a substantially helical shape about an axis with a first end terminating at a first plane and a second end terminating at a second plane;

the first plane forming an angle with the second plane, with a vertex at the axis, of between about 90° and about 180°;

the body including a composite region, disposed at an outer portion of the body, having an aggregate hardness greater than a hardness of portions of the body not including the composite region; and the body including a top surface disposed between the first end and the second end, the top surface having at least one of:

a stepped profile; or one or more loops or hooks protruding from the top surface.

20. The cast component of claim 19, further comprising a bottom surface disposed between the first end and the second end, and at least one of:

a mounting hole passing from the top surface to the bottom surface; or a support bar protruding from the bottom surface proximal to an outer sidewall of the body.

* * * * *